US007618756B2

(12) United States Patent
Wu et al.

(10) Patent No.: US 7,618,756 B2
(45) **Date of Patent: *Nov. 17, 2009**

(54) PHOTOCONDUCTORS CONTAINING CHELATING COMPONENTS

(75) Inventors: Jin Wu, Webster, NY (US); Kent J. Evans, Lima, NY (US); Dennis J. Prosser, Walworth, NY (US); Liang-Bih Lin, Rochester, NY (US); Raymond K. Crandall, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 323 days.

This patent is subject to a terminal disclaimer.

(21) Appl. No.: 11/714,599

(22) Filed: Mar. 6, 2007

(65) Prior Publication Data

US 2008/0220352 A1 Sep. 11, 2008

(51) Int. Cl.
*G03G 5/04* (2006.01)

(52) U.S. Cl. ..... 430/58.65; 430/59.1; 430/59.4; 430/59.5

(58) Field of Classification Search ..... 430/58.65, 430/59.1, 59.4, 59.5
See application file for complete search history.

(56) References Cited

U.S. PATENT DOCUMENTS 4,251,615 A * 2/1981 Rosenthal ..... 430/89
4,464,450 A 8/1984 Teuscher
4,921,769 A 5/1990 Yuh et al.
4,921,773 A 5/1990 Melnyk et al.
5,449,573 A * 9/1995 Aoki et al. ..... 430/131
6,156,468 A 12/2000 Wehelie et al.
6,177,219 B1 1/2001 Yuh et al.
6,255,027 B1 7/2001 Wehelie et al.
6,913,863 B2 7/2005 Wu et al.
7,037,631 B2 5/2006 Wu et al.
2005/0042533 A1 * 2/2005 Wu et al. ..... 430/64

OTHER PUBLICATIONS

John F. Yanus et al., U.S. Appl. No. 11/593,875 on Silanol Containing Overcoated Photoconductors, filed Nov. 7, 2006.
John F. Yanus et al., U.S. Appl. No. 11/593,657 on Overcoated Photoconductors with Thiophosphate Containing Charge Transport Layers, filed Nov. 7, 2006.
John F. Yanus et al., U.S. Appl. No. 11/593,656 on Silanol Containing Charge Transport Overcoated Photoconductors, filed Nov. 7, 2006.
John F. Yanus et al., U.S. Appl. No. 11/593,662 on Overcoated Photoconductors with Thiophosphate Containing Photogenerating Layer, filed Nov. 7, 2006.
Jin Wu et al., U.S. Appl. No. 11/605,522 on Thiophosphate Containing Photoconductors, filed Nov. 28, 2006.

* cited by examiner

*Primary Examiner*—John L Goodrow
(74) *Attorney, Agent, or Firm*—E. O. Palazzo

(57) ABSTRACT

A photoconductor containing a supporting substrate, a photogenerating layer; and at least one charge transport layer where the photogenerating layer contains a photogenerating pigment and a chelating additive or agent.

27 Claims, No Drawings

PHOTOCONDUCTORS CONTAINING CHELATING COMPONENTS

CROSS REFERENCE TO RELATED APPLICATIONS

U.S. application Ser. No. 11/714,613, Publication No. 20080220351, filed Mar. 6, 2007, on Photoconductors Containing Photogenerating Chelating Components by Jin Wu et al.

U.S. application Ser. No. 11/593,875, Publication No. 20080107985, filed Nov. 7, 2006, on Silanol Containing Overcoated Photoconductors by John F. Yanus et al.

U.S. application Ser. No. 11/593,657, Publication No. 20080107984, filed Nov. 7, 2006, on Overcoated Photoconductors with Thiophosphate containing Charge Transport Layers by John F. Yanus et al.

U.S. application Ser. No. 11/593,656, Publication No. 20080107979, filed Nov. 7, 2006, on Silanol Containing charge Transport Overcoated Photoconductors by John F. Yanus et al.

U.S. application Ser. No. 11/593,662, Publication No. 20080107983, filed Nov. 7, 2006, on Overcoated Photoconductors with Thiophosphate Containing Photogenerating Layer by John F. Yanus et al.

A number of the components of the above cross-referenced patent applications, such as the supporting substrates, the halogenated polymer for the hole blocking layer, the photogenerating layer pigments and binders, the charge transport layer molecules and binders, the adhesive layer materials, and the like may be selected for the photoconductors of the present disclosure in embodiments thereof.

BACKGROUND

This disclosure is generally directed to imaging members, photoreceptors, photoconductors, and the like. More specifically, the present disclosure is directed to rigid or multilayered flexible, belt imaging members, or devices comprised of an optional supporting medium like a substrate, an optional undercoat or hole blocking layer usually situated between the substrate and the photogenerating layer, a chelating component or agent which primarily functions to passivate the impurities, such as metallic materials present in the photogenerating pigment and/or photogenerating pigment dispersion to, for example, achieve acceptable, that is minimal, charge deficient spots (CDS), and at least one charge transport layer, wherein at least one is from 1 to about 5, from 1 to about 3, 2, one, and the like, such as a first charge transport layer and a second charge transport layer, an optional adhesive layer, and an optional overcoating layer, and wherein at least one of the charge transport layers contains at least one charge transport component, and a polymer or resin binder, and where in embodiments the resin binder selected for the undercoat layer is a known suitable binder including a binder that is substantially insoluble in a number of solvents like methylene chloride, examples of these binders being illustrated in copending application Ser. No. 11/593,658, filed Nov. 7, 2006, the disclosure of which is totally incorporated herein by reference. In embodiments, there is disclosed a photoconductor where the photogenerating dispersion contains a chelating agent which, for example, captures impurities, such as metallic substances, that are present in the selected photogenerating pigment as obtained or that are formed, such as by attritor milling, during the preparation of the photogenerating pigment layer solution.

In embodiments there are disclosed low charge deficient spots (CDS) photoconductors where the photogenerating pigment impurities are passivated by chelating agents or a chelating agent. Also, when present the hole blocking layer can contain in embodiments phenol resins, known hole blocking layer polymers as illustrated in U.S. Pat. No. 6,913,863, the disclosure of which is totally incorporated herein by reference, which discloses a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, or chlorinated polymeric resins as the binder, and a hydrolyzed aminosilane as the electroconducting species since it is believed that the $CH_2Cl_2$ insoluble binders prevent or minimize the migration of hole transport molecules from the upper charge transport layer into lower layers and then into the undercoat or ground plane layer. Examples of chlorinated homopolymers include polyvinylidene chloride, chlorinated polyvinyl chloride, and chlorinated polyvinylidene chloride. Examples of chlorinated copolymers include copolymers of vinylidene chloride, chlorinated vinyl chloride and chlorinated vinylidene chloride with vinylidene fluoride, tetrafluoroethylene, trifluorochloroethylene, hexafluoropropylene, and the like.

A number of advantages are associated with the disclosed photoconductors, such as for example the formation of minimal charge deficient spots (CDS) which result in undesirable printing defects, and where the spots can be generated from the photogenerating layer, and the charge transport layer or layers; minimization or prevention of the migration of hole transport molecules or components from one charge transport layer to another layer in the photoconductor, such as the photogenerating layer and the charge transport layer, and more specifically, from the top or upper charge transport layer into lower layers of the photoconductor, such as lower charge transport layers and the lower photogenerating layer thereby permitting less undesirable charge deficient spots in the developed image generated. The photoreceptors illustrated herein, in embodiments, have extended lifetimes; possess excellent, and in a number of instances low $V_r$ (residual potential); and allow the substantial prevention of $V_r$ cycle up when appropriate; high sensitivity; low acceptable image ghosting characteristics; and desirable toner cleanability.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the photoconductor is to be used in a printing mode, the imaging method involves the same operation with the exception that exposure can be accomplished-with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer, and which layers can include a number of resin binders. Examples of photogenerating layer components disclosed in the '990 patent include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above-recited patents may be selected for the present disclosure in embodiments thereof. More specifically, a number of the components and amounts thereof of the above patents, such as the supporting substrates, resin binders for the charge transport layer, photogenerating layer components like hydroxygallium phthalocyanines (OHGaPc), antioxidants, charge transport components, hole blocking layer components, adhesive layers, and the like, may be selected for the members of the present disclosure in embodiments thereof.

SUMMARY

Disclosed are imaging members with many of the advantages illustrated herein, such as the minimal generation of charge deficient spots, extended lifetimes of service of, for example, about 2,000,000 imaging cycles; excellent electronic characteristics; stable electrical properties; low image ghosting; resistance to charge transport layer cracking upon exposure to the vapor of certain solvents; consistent $V_r$ (residual potential) that is substantially flat or no change over a number of imaging cycles as illustrated by the generation of known PIDC (Photo-Induced Discharge Curve), and the like.

Further disclosed are layered flexible photoresponsive imaging members with sensitivity to visible light.

Moreover, disclosed are layered belt photoresponsive or photoconductive imaging members with mechanically robust and solvent resistant charge transport layers.

EMBODIMENTS

Aspects of the present disclosure relate to an imaging member comprising an optional supporting substrate; a photogenerating layer comprised of a photogenerating component optionally dispersed in a resin or polymer binder, and where the photogenerating pigment impurities are captured by, and complexed with a chelating agent, that is for example, where the chelating agent bonds to the impurities to thereby suppress the formation of undesirable charge deficient spots; and at least one charge transport layer, such as from 1 to about 7 layers, from 1 to about 5 layers, from 1 to about 3 layers, 2 layers, or 1 layer; a flexible photoconductor comprising in sequence a substrate, a photogenerating layer pigment substantially free of electrically inactive metallic impurities, and at least one charge transport layer comprised of at least one charge transport component comprised of hole transport molecules and a resin binder, and an optional hole blocking layer comprised, for example, of an aminosilane and a halogenated, such as a chlorinated, polymeric resin that is insoluble or substantially insoluble in methylene chloride, and a number of other similar solvents; a photoconductive member with a photogenerating layer of a thickness of from about 0.1 to about 10 microns, at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, a photogenerating layer comprised of a photogenerating pigment prepared from a dispersion of the pigment and a chelating agent, and dispersed in a polymeric binder, and a charge transport layer or layers, and thereover an overcoating charge transport layer, and where the transport layer is of a thickness of from about 40 to about 75 microns; a member wherein the photogenerating layer contains a binder like a polycarbonate, and dispersed therein a photogenerating pigment free of adverse metallic impurity affects, and present in an amount of from about 5 to about 95 weight percent; a member wherein the thickness of the photogenerating layer is from about 0.1 to about 4 microns; a member wherein hole blocking layer polymer binder is present in an amount of from about 0.1 to about 90, from 1 to about 50, from 2 to about 25, from 5 to about 10 percent by weight, and wherein the total of all blocking layer components is about 100 percent; a member wherein the photogenerating component is a hydroxygallium phthalocyanine substantially free of electrically active metallic impurities that adversely impact the hydroxygallium phthalocyanine, and where charge deficient spots (CDS) are avoided, and that absorbs light of a wavelength of from about 370 to about 950 nanometers; an imaging member or photoconductor wherein the supporting substrate is comprised of a conductive substrate comprised of a metal; an imaging member wherein the conductive substrate is aluminum, aluminized polyethylene terephthalate or titanized polyethylene terephthalate; a photoconductor or an imaging member wherein the photogenerating pigment is a metal free phthalocyanine; a photoconductor or an imaging member wherein the photogenerating pigment is titanyl phthalocyanine; a photoconductor or an imaging member wherein the photogenerating pigment is a chlorogallium phthalocyanine; an imaging member wherein each of the charge transport layers comprises

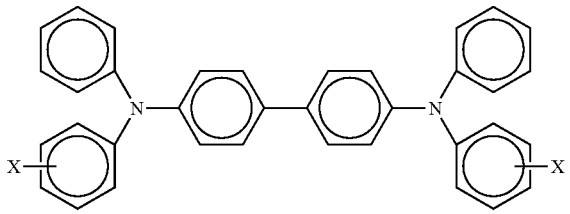

wherein X is selected from the group consisting of a suitable hydrocarbon like alkyl, alkoxy, aryl, and substituted derivatives thereof; halogen, and mixtures thereof, or wherein X can be included on the four terminating rings; an imaging member wherein alkyl and alkoxy contain from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

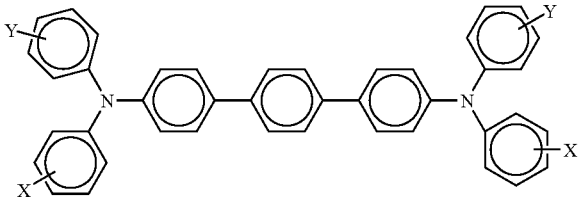

wherein X and Y are independently alkyl, alkoxy, aryl, a halogen, or mixtures thereof; an imaging member wherein for the above terphenyl amine alkyl and alkoxy each contains from about 1 to about 12 carbon atoms; an imaging member wherein alkyl contains from about 1 to about 5 carbon atoms; an imaging member wherein the photogenerating pigment present in the photogenerating layer is comprised of chlorogallium phthalocyanine, titanyl phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta±0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 0.05 weight percent to about 95 weight percent, and wherein the photogenerating pigment is dispersed in from about 96 weight percent to about 5 weight percent of polymer binder, and where the hole blocking layer contains a chlorinated polymer binder; a member wherein the thickness of the photogenerating layer is from about 0.2 to about 12 microns; an imaging member wherein the charge transport layer resinous binder is selected from the group consisting of polyesters, polyvinyl butyrals, polycarbonates, polyarylates, copolymers of polycarbonates and polysiloxanes, polystyrene-b-polyvinyl pyridine, and polyvinyl formals; an imaging member wherein the photogenerating component is Type V hydroxygallium phthalocyanine, titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules; an imaging member wherein the photogenerating layer contains an alkoxygallium phthalocyanine; a photoconductive imaging member with an aminosilane and chlorinated polymer containing blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a hole blocking or undercoat layer as illustrated herein, a photogenerating layer, a hole transport layer, and a top overcoating layer in contact with the hole transport layer, or in embodiments, in contact with the photogenerating layer, and in embodiments wherein a plurality of charge transport layers are selected, such as for example, from 2 to about 10, and more specifically, 2 may be selected; and a photoconductive imaging member comprised in sequence of a supporting substrate, a hole blocking layer; a photogenerating layer comprised of a photogenerating pigment, and where the metallic impurities are bonded and captured by a chelating agent; and a first, second, or third charge transport layer; and a photoconductor comprising in sequence a substrate, a hole blocking or undercoat layer, a photogenerating pigment layer which includes impurities bonded to a chelating agent thereby avoiding or minimizing undesirable charge deficient spots, and at least one charge transport layer comprised of at least one charge transport component, and a resin binder; a photoconductor wherein said charge transport layer is comprised of at least one of

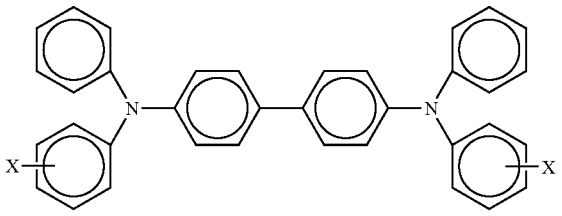

-continued

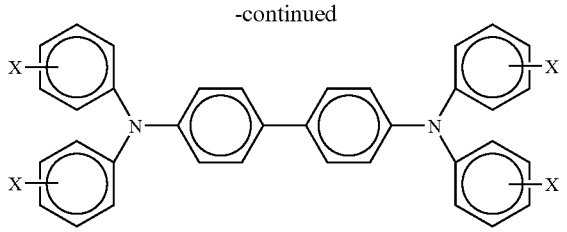

wherein X is selected from the group consisting of at least one of alkyl, alkoxy, aryl, and halogen; a photoconductor wherein said charge transport layer is comprised of at least one of

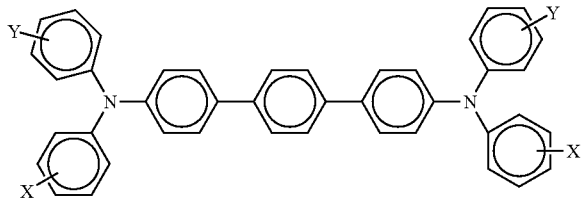

wherein each X and Y is independently selected from the group consisting of alkyl, alkoxy, aryl, halogen, and mixtures thereof; and

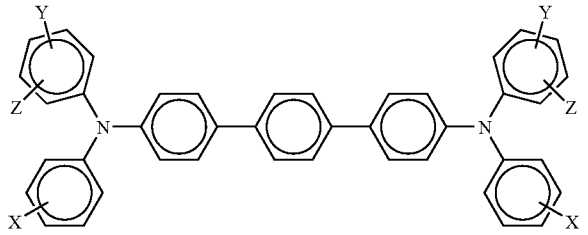

and wherein X, Y and Z are independently selected from the group consisting of alkyl, alkoxy, aryl, substituted derivatives thereof, and halogen; and mixtures thereof.

A number of suitable chelating agents can be selected, in various effective amounts, such as for example, from about 0.05 to about 30, from about 1 to about 20, or from about 2 to about 10 weight percent based on the total amount of the components in the photogenerating layer, and which components include, for example, the photogenerating pigment or pigments, resin binder, chelating agent bonded or attached to the pigment impurities, and suitable additives. Examples of the chelating agents include amides, such as carboxamides (—$CONH_2$) and sulfonamides (—$SO_2NH_2$); examples of carboxamides include lactamide, glycolamide, succinamide, oxamide, formamide, acetamide, behenamide, 2,2-diethoxyacetamide, acrylamide, benzamide, glucuronamide, isonicotinamide, niacinamide, pyrazinecarboxamide, diamide, and examples of sulfonamides include 5-(dimethylamino)-1-naphthalenesulfonamide, cyclopropanesulfonamide; a number of other suitable known chelating agents include β-diketones such as acetyl acetone and 2,4-heptanedione, ketoesters such as methyl acetoacetate, ethyl acetoacetate, propyl acetoacetate and butyl acetoacetate, hydroxyl carboxylic acids such as butyric acid, salicylic acid and maleic acid, hydroxyl carboxylic acid esters such as methyl lactate, ethyl salicylate and ethyl maleate, keto alcohols such as 4-hydroxy-4-methyl-2-pentanone, amino alcohols such as triethanolamine, and mixtures thereof, and more specifically, β-hydroxyketone or β-diketone-containing substances, especially small-molecule β-hydroxyketones or β-diketones such as 4-hydroxy-4-methyl-2-pentanone, acetyl acetone, ethyl acetoacetate, and the like.

Specific examples of chelating agents include amide polymers and molecules such as lactamide, oxamide, succinamide, or mixtures thereof of the following representative formulas/structures

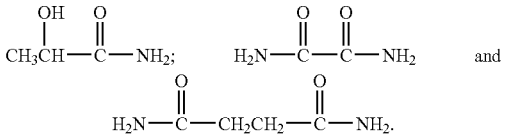

The β-hydroxyketones or β-diketones can be polymeric or small molecules. Examples of the small molecules are β-hydroxyketones or β-diketones such as 4-hydroxy-4-methyl-2-pentanone, acetyl acetone and ethyl acetoacetate, respectively

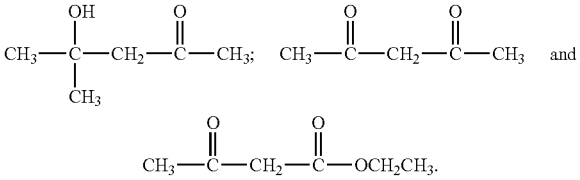

The thickness of the photoconductor substrate layer depends on a number of factors, including economical considerations, electrical characteristics, and the like, thus this layer may be of a thickness, for example over 3,000 microns, such as from about 1,000 to about 3,000 microns, from about 1,000 to 2,000 microns, from about 500 to about 1,200 microns, or from about 300 to about 700 microns, or of a minimum thickness. In embodiments, the thickness of this layer is from about 75 microns to about 300 microns, or from about 100 to about 150 microns.

The substrate may be opaque or substantially transparent and may comprise any suitable material that functions as a supporting layer for the hole blocking, adhesive, photogenerating, and charge transport layers, and which substrate should possess the appropriate mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum photoconductor, this layer may be of a substantial thickness of, for example, up to many centimeters or of a minimum thickness of less than a millimeter. Similarly, a flexible belt may be of a substantial thickness of, for example, about 250 micrometers, or of minimum thickness of equal to or less than about 50 micrometers, such as from about 5 to about 45, from about 10 to about 40, from about 1 to about 25, or from about 3 to about 45 micrometers. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, about 60 weight percent of Type V hydroxygallium phthalocyanine or chlorogallium phthalocyanine, and about 40 weight percent of a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 4 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

Photogenerating layer examples may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Various suitable and conventional known processes may be used to mix, and thereafter, apply the photogenerating layer coating mixture containing the chelating agent like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.2 to about 5 microns can be applied to or deposited on the substrate, on other surfaces in between the substrate, and the charge transport layer, and the like. The photogenerating dispersion applied to the photoconductor contains captured impurities, such as metallic impurities that is these impurities are attached or bonded to the chelating agent thus rendering them electrically inactive.

For the deposition of the photogenerating layer, it is desirable to select a coating solvent that may not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of suitable known charge transport components, molecules, or compounds can be selected for the charge transport layer, which layer is generally of a thickness of from about 5 microns to about 90 microns, and more specifically, of a thickness of from about 10 microns to about 40 microns, such as aryl amines of the following formula/structure

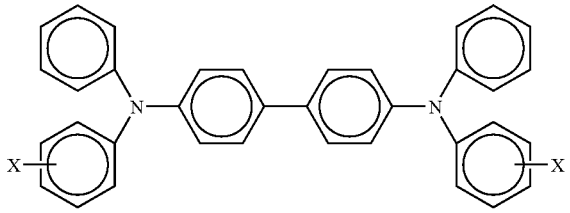

wherein X, which X may also be contained on each of the four terminating rings, is a suitable hydrocarbon such as alkyl, alkoxy, aryl, derivatives thereof, or mixtures thereof; and a halogen, or mixtures of the hydrocarbon and halogen, and especially those substituents selected from the group consisting of Cl and $CH_3$; and molecules of the following formula

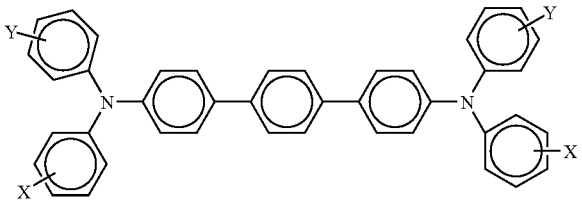

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines present in an amount of from about 20 to about 90 weight percent include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, and present in an amount of from about 40 to about 90 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 micron to about 5 microns. Various suitable and conventional methods may be used to mix, and thereafter apply the charge transport layer and an overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure can in embodiments transport holes during imaging and should not have too high a free carrier concentration. Free carrier concentration in the overcoat increases the dark decay. Examples of overcoatings, such as PASCO, are illustrated in copending applications, the disclosures of which are totally incorporated herein by reference.

The optional hole blocking or undercoat layer for the imaging members of the present disclosure can contain a number of components as illustrated herein, including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'- isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene) bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene) bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

Hole blocking layer components can comprise an aminosilane such as 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl-3-amino)propyl triethoxysilane, N,N-dimethylaminophenyl triethoxysilane, trimethoxysilylpropyldiethylene triamine, and the like, and mixtures thereof. Specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane. (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA™ STAB AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the layers specifically disclosed herein are not intended to be exhaustive. Thus, a number of suitable components, polymers, formulas, structures, and R groups or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 12 carbon atoms, includes 1, 2, 3, 4, 5, 6, 7, 8, 9, 10, 11, and 12, up to 25, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated.

COMPARATIVE EXAMPLE 1

An imaging member or photoconductor was prepared by providing a 0.02 micron thick titanium layer coated (the coater device) on a biaxially oriented polyethylene naphthalate substrate (KALEDEX™ 2000) having a thickness of 3.5 mils, and applying thereon, with a gravure applicator, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer, using a gravure applicator, and which adhesive contained 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or POLYCARBONATE PCZ™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting imaging member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

EXAMPLE I

An imaging member or photoconductor was prepared by repeating the process of Comparative Example 1 except that there was added to the photogenerating dispersion 0.24 gram, about 5 weight percent, of the chelating agent lactamide. Thereafter, the resulting solution was applied to the above substrate with a Bird applicator to form a photogenerating layer. After drying at 120° C. for 1 minute, the photogenerating layer dry thickness was about 0.5 μm.

EXAMPLE II

An imaging member or photoconductor was prepared by repeating the process of Comparative Example 1 except that there was added to the photogenerating dispersion 0.24 gram, about 5 weight percent, of the chelating agent oxamide. Thereafter, the resulting solution was applied to the above substrate with a Bird applicator to form a photogenerating layer, which after drying at 120° C. for 1 minute there was obtained a dry thickness of about 0.5 μm.

EXAMPLE III

An imaging member or photoconductor was prepared by repeating the process of Comparative Example 1 except that there was added to the photogenerating dispersion 0.24 grams about 5 weight percent, of the chelating agent succinamide. Thereafter, the resulting solution was applied to the above substrate with a Bird applicator to form a photogenerating layer, which after drying at 120° C. for 1 minute there resulted a dry thickness of about 0.5 μm.

Electrical Property Testing

The above prepared photoconductors were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.).

Compared with the imaging member of Comparative Example 1, the disclosed member of Examples I, II and III exhibited almost identical PIDCs. Thus, incorporation of the chelating agents into the photogenerating layer did not adversely affect the electrical properties of the imaging member.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the micro-defect levels of an electrophotographic imaging member. The method of U.S. Pat. No. 5,703,487, the disclosure of which is totally incorporated herein by reference, designated as field-induced dark decay (FIDD), involves measuring either the differential increase in charge over and above the capacitive value or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

U.S. Pat. Nos. 6,008,653 and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, a floating fixture which maintains a substantially constant distance between the probe and the imaging surface. A constant voltage charge is applied to the imaging surface prior to relative movement of the probe and the imaging surface past each other, and the probe is synchronously biased to within about ±300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots.

The photoconductors of the above Examples were measured for CDS counts using the above-described FPS technique, and the results follow in Table 1.

TABLE 1

| | CDS (counts/cm$^2$) |
|---|---|
| Comparative Example 1 | 13 |
| Example I | 5.2 |
| Example II | 7.2 |
| Example III | 4.9 |

The above CDS data demonstrated that the photoconductors containing the chelating agent bound or attached to the metallic impurities had a CDS that was minimal and suppressed, and more specifically, improved by from about 40 to about 60 percent as compared to the photoconductor of Comparative Example 1 (control) with a CDS of 13.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer, and wherein said photogenerating layer contains a chelating additive, and wherein said chelating additive is selected from the group consisting of at least one of a lactamide, a glycolamide, a succinamide, an oxamide, a formamide, an acetamide, a behenamide, an acrylamide, a benzamide, a glucuronamide, an isonicotinamide, a niacinamide, and a pyrazinecarboxamide diamide.

2. A photoconductor in accordance with claim 1 wherein said photogenerating layer is prepared from a dispersion of a photogenerating pigment and said chelating additive.

3. A photoconductor in accordance with claim 1 wherein said photogenerating layer is prepared from a dispersion of a photogenerating pigment, a solvent, and said chelating additive.

4. A photoconductor in accordance with claim 1 wherein said photogenerating layer is comprised of at least one photogenerating pigment, a polymer binder, and said chelating additive.

5. A photoconductor in accordance with claim 1 wherein said chelating additive is a lactamide.

6. A photoconductor in accordance with claim 1 wherein said chelating additive is an oxamide.

7. A photoconductor in accordance with claim 1 wherein said chelating additive is a succinamide.

8. A photoconductor in accordance with claim 1 wherein said charge transport layer is comprised of at least one of

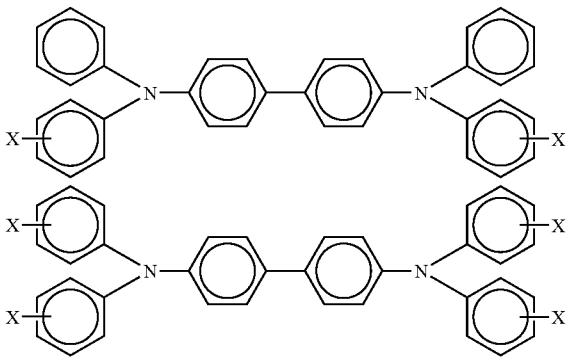

wherein X is selected from the group consisting of at least one of alkyl, alkoxy, aryl, and halogen.

9. A photoconductor in accordance with claim 8 wherein alkyl and alkoxy each contain from about 1 to about 10 carbon atoms, and optionally wherein said chelating additive is 2,2-diethoxyacetamide.

10. A photoconductor in accordance with claim 8 wherein said charge transport layer is comprised of the aryl amine N,N'-diphenyl-N, N-bis(3-methylphenyl)-1,1'-biphenyl-4,4'-diamine.

11. A photoconductor in accordance with claim 1 wherein said charge transport layer is comprised of at least one of

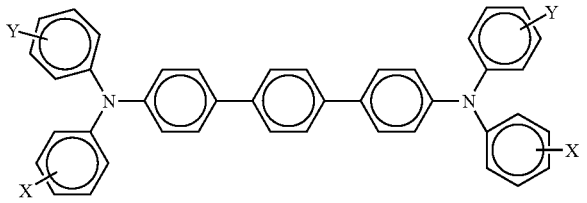

wherein each X and Y is independently selected from the group consisting of alkyl, alkoxy, aryl, halogen, and mixtures thereof; and

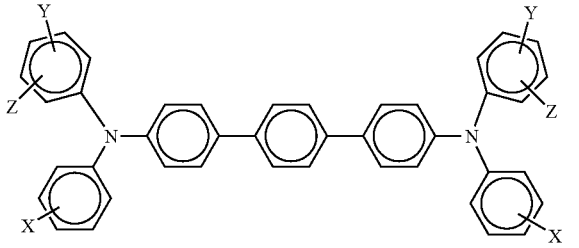

and wherein X, Y and Z are independently selected from the group consisting of alkyl, alkoxy, aryl, substituted derivatives thereof, and halogen; and mixtures thereof.

12. A photoconductor in accordance with claim 11 wherein each alkoxy and alkyl contains from about 1 to about 10 carbon atoms; aryl contains from 6 to about 36 carbon atoms; and halogen is chloride, bromide, fluoride, or iodide.

13. A photoconductor in accordance with claim 1 wherein said charge transport layer is comprised of at least one of N,N'-bis(4-butylphenyl)-N ,N'-di-p-tolyl-[p-terphenyl]-4,4"-diamine, N, N'-bis(4-butylphenyl) -N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N ,N'-bis-(4-isopropylphenyl)-[p-terphenyl]-4,4"-diamine, N,N'-bis(4-butylphenyl)-N,N'-bis -(2-ethyl-6-methylphenyl)-[p-terphenyl]4,4"-diamine, N,N'-bis(4-butylphenyl) -N,N'-bis-(2,5-dimethylphenyl)-[p-terphenyl]-4,4"-diamine and N,N'-diphenyl -N,N'-bis(3-chlorophenyl)-[p-terphenyl]-4,4"-diamine, and mixtures thereof.

14. A photoconductor in accordance with claim 1 wherein said at least one charge transport layer contains an antioxidant optionally comprised of a hindered phenol or a hindered amine.

15. A photoconductor in accordance with claim 1 wherein said at least one charge transport layer is from 1 to about 7 layers.

16. A photoconductor in accordance with claim 1 wherein said at least one charge transport layer is from 2 to about 3 layers.

17. A photoconductor in accordance with claim 1 wherein said at least one charge transport layer is comprised of a top charge transport layer and a bottom charge transport layer, and wherein said bottom layer is situated between said photogenerating layer and said top layer.

18. A photoconductor in accordance with claim 1 wherein said photogenerating layer is comprised of at least one of a chiorogallium phthalocyanine, a titanyl phthalocyanine, a halogallium phthalocyanine, a perylene, or mixtures thereof.

19. A photoconductor in accordance with claim 1 wherein said photogenerating pigment is comprised of a hydroxygallium phthalocyanine, and said substrate is present.

20. A flexible photoconductor comprising in sequence a supporting substrate layer, a photogenerating layer, and at least one charge transport layer comprised of at least one charge transport component, and a resin binder; and wherein said photogenerating layer is comprised of at least one photogenerating pigment and a chelating agent , and wherein said chelatinQ aQent is at least one of a carboxamide (—$CONH_2$) and a sulfonamide (—$SO_2NH_2$).

21. A photoconductor comprising in sequence a supporting substrate, a photogenerating layer comprised of at least one photogenerating pigment, and a chelating agent; and a hole transport layer , and wherein said chelating agent is selected from the group consisting of at least one of a lactamide, a glycolamide, a succinamide, an oxamide, a formamide, an acetamide, a behenamide, an acrylamide, a benzamide, a glucuronamide, an isonicotinamide, a niacinamide, and a pyrazinecarboxamide diamide.

22. A photoconductor in accordance with claim 20 wherein at least one charge transport layer is comprised of from 1 to 3 layers, and said sulfonamide is selected from the group consisting of at least one of 5-(dimethylamino-1-naphthalenesulfonamide, and a cyclopropanesulfonamide.

23. A photoconductor in accordance with claim 20 wherein at least one charge transport layer is comprised of two layers, a bottom layer in contact with and contiguous to said photogenerating layer, and a top charge transport layer contiguous to and in contact with the bottom charge transport layer, and said chelating additive is a lactamide, an oxamide, or a succinamide.

24. A photoconductor in accordance with claim 1 wherein said chelating additive present in an amount of from about 0.1 to about 25 weight percent is at least one of

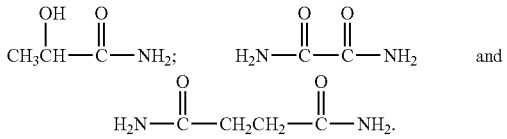

and

25. A photoconductor in accordance with claim 20 wherein said chelating agent present in an amount of from about 1 to about 15 weight percent is at least one of

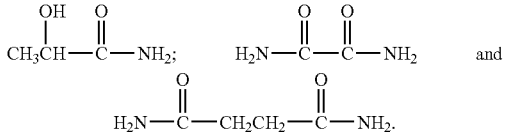

and

26. A photoconductor in accordance with claim 1 further including a hole blocking layer and an adhesive layer.

27. A photoconductor in accordance with claim 1 wherein said photogenerating layer is comprised of a photogenerating pigment, a polymer binder, and said chelating agent with captured metallic impurities, and where said impurities are captured from the photogenerating layer dispersion of said pigment, said polymer, and said chelating agent prior to the application of said dispersion to said photoconductor substrate.

* * * * *